United States Patent [19]

Robb

[11] 4,449,462

[45] May 22, 1984

[54] COAL BURNING APPARATUS

[75] Inventor: Michael F. Robb, Bismarck, N. Dak.

[73] Assignee: King Coal Furnace Corporation, Bismarck, N. Dak.

[21] Appl. No.: 425,547

[22] Filed: Sep. 28, 1982

[51] Int. Cl.[3] ..... F23K 3/10

[52] U.S. Cl. ..... 110/288; 110/287; 110/247; 110/255; 110/327

[58] Field of Search ..... 110/288, 287, 286, 263, 110/275–277, 247, 255, 327

[56] References Cited

U.S. PATENT DOCUMENTS

| | | | |
|---|---|---|---|
| 1,598,579 | 8/1926 | Van Brunt et al. | 110/287 |
| 1,871,653 | 8/1932 | Best | 110/275 |
| 1,921,864 | 8/1933 | Brossman | 110/275 |
| 1,928,167 | 9/1933 | Bressler | 110/287 |
| 2,033,919 | 3/1936 | Burton | 110/277 |
| 2,119,937 | 6/1938 | Banfield | 110/287 |
| 2,171,862 | 9/1939 | Peltz | 110/327 |
| 2,253,694 | 8/1941 | Drawz | 110/45 |
| 2,359,638 | 10/1944 | Greger | 110/288 |
| 2,396,888 | 3/1946 | Scholl | 110/288 |
| 2,405,982 | 8/1946 | Schweickart et al. | 110/277 |
| 2,455,817 | 12/1948 | Sherman | 110/45 |
| 3,680,503 | 8/1972 | Danielsson et al. | 110/347 |
| 4,007,697 | 2/1977 | Prill | 110/288 |

FOREIGN PATENT DOCUMENTS

| | | | |
|---|---|---|---|
| 64394 | 4/1946 | Denmark | 110/288 |

*Primary Examiner*—Henry C. Yuen
*Attorney, Agent, or Firm*—Kinney & Lange

[57] ABSTRACT

A coal burning apparatus actuated by a stoker of the underfeed type includes a burner body formed of a plurality of vertically stacked rings with spaces between the rings extending horizontally to form a tuyère. A tuyère is easily made by stacking rings onto a burner base in a surrounding relationship to the stoker throat. A rotating ash ring is mounted to the exterior of the tuyère for disposing ashes outwardly beyond the periphery of the burner so that they may fall into a provided ash box. The burner air for sustaining combustion is provided to the interior of the tuyère from one of a pair of provided ports in the burner base. The alternative location of the air ports permit the air duct for providing combustion air to be extended from either end of the burner assembly.

11 Claims, 8 Drawing Figures

COAL BURNING APPARATUS

BACKGROUND OF THE INVENTION

1. Field of the Invention.

The present invention relates to coal burners utilizing underfeed stokers, and incorporating improved burner construction.

2. Description of the Prior Art.

Coal burners and underfeed stokers are well known in the prior art, and many of these burners utilize a rotating ash ring for removal of ashes from the burner body to prevent the build-up of clinkers. For example, U.S. Pat. No. 1,871,653 issued to M. W. Best in August of 1932 shows a rotating fire pot base which is used for aiding in ash removal. This burner device includes an underfeed stoker.

U.S. Pat. No. 1,921,864, issued to Brossman in August of 1933, also shows an underfeed rotary grate stoker that has an ash ring that is rotatably mounted around a central burner body, and the rotating grate aids in the disintegration of clinkers and removal of ashes.

U.S. Pat. No. 2,033,919, issued in March of 1936 to Burton, shows a burner with a central throat member made of discs that are vertically stacked and including a rotating grate surrounding the throat member.

U.S. Pat. No. 2,396,888 to Scholl, issued in March of 1946, shows a stoker fed burning apparatus that includes a plenum chamber for receiving the blower air, and a vertical wall in the burner apparatus that distributes the air, and which includes an ash ring that is oscillated during the time that the burner is in operation and the stoker is being operated.

U.S. Pat. No. 2,455,817, issued to Sherman in December of 1948, also shows an underfeed stoker apparatus having a delivery throat for coal, and an apertured plenum chamber that provides air to the burning mass of coal.

U.S. Pat. No. 2,405,982 to Schweickart et al., issued in August of 1946, illustrates an underfeed stoker that has an ash removal mechanism, air feed, and includes a rotary grate structure that is driven around the central axis of the burner.

Additionally, U.S. Pat. No. 4,007,697 issued to Prill in February 1977, shows a stoker apparatus having a rotating ash ring with a central burner that has a tapered upper burner surface.

A burner construction using parallel plates that are spaced apart in vertical direction as shown in U.S. Pat. No. 2,253,694, issued to Drawz in August of 1941.

Each of the above patents show different burner constructions, including rotating rings, but yet in large in commercial stokers, the need for a device that provides good capacity, adaptability to different sizes to minimize manufacturing costs selectively still persists.

SUMMARY OF THE INVENTION

The present invention relates to a coal burning apparatus having an underfeed stoker and comprising a burner assembly with a central throat through which coal is supplied. A plurality of vertically stacked rings surround the throat and form a burner body. The rings are spaced apart in vertical direction to provide annular horizontal air passageways between the rings. Air is supplied to a central chamber of the burner body so that air flows outwardly horizontally through the rings to provide combustion air to coal being discharged from the top port of the throat above the rings. The coal moves down the exterior of the vertically stacked rings as it burns.

The burner assembly has a base which supports the rings and also forms a receptacle at its outer edge portions for receiving coal and products of combustion, as well as ashes. A rotating ring is spaced from and surrounds the burner body at its outer periphery. The ash ring is driven by the stoker drive to break-up clinkers and large pieces of ash, and eventually discharge the ash over the outer edge of the ash ring into an ash receptacle.

The burner base plate is made with two air openings or ports leading thereto. A duct elbow for combustion air supplied to the burner is connected to one port and the other port is blocked. The input air duct can extend in the same direction as the stoker feed auger when connected to a first port, or from opposite direction when connected to the other port using the same duct elbow. The air port that is not used in the burner body is closed. A plenum chamber is formed in the burner base for distribution of air evenly around a substantial portion of the burner base.

The burner assembly is easily constructed and many of the parts are adapted to use with burners of varying sizes, making the manufacturing costs reasonable so that the burner is available to a wide number of users.

DETAILED DESCRIPTION OF THE PREFERRED EMBODIMENTS

Figure 1:
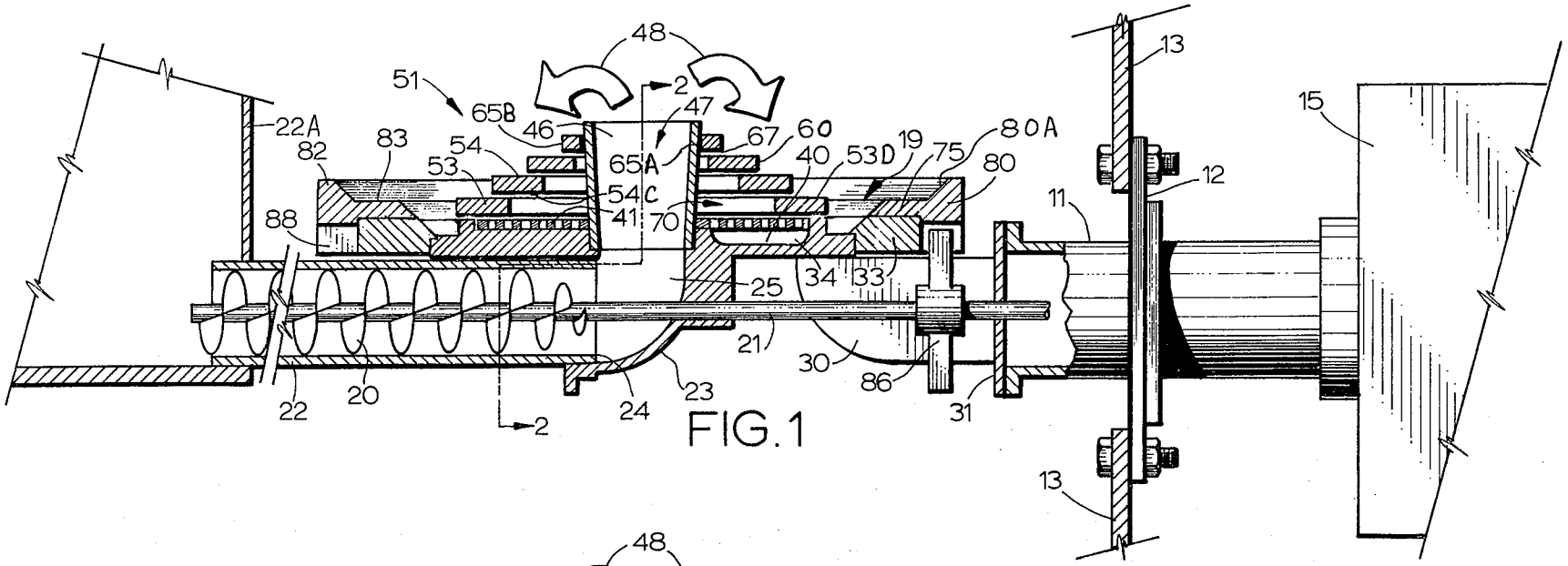
FIG. 1 is a part schematic representation of a stoker drive and stoker including a burner of the present invention.
Figure 4:
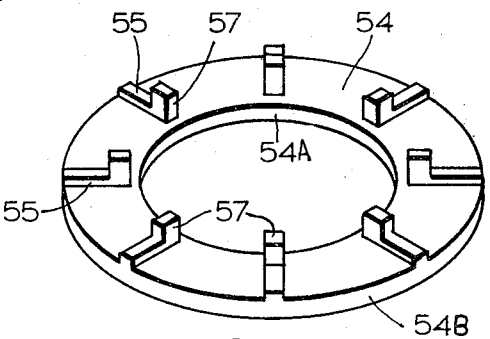
FIG. 4 is a perspective view of the underside of a typical burner ring made according to the present invention.

In FIG. 1, an overall view of the burner and coal supply stoker is schematically shown. The burner assembly indicated at 10 is shown supported through a tubular housing 11 from a mounting plate 12 that is bolted to a boiler base 13, or other similar furnace housing. The tubular housing 11 in turn is connected to a stoker transmission indicated generally at 15. The stoker transmission 15 is a drive of conventional design that is used for driving a stoker auger indicated at 20, through a shaft 21 and suitable couplings that are conventional in design.

The burner body 10 is supported on the interior of the boiler or furnace and provides a combustion chamber indicated generally at 19 into which the burning coal will move as will be explained.

The auger 20 is mounted in an auger housing tube 22 which extends from a suitable coal supply hopper 22A and the auger 20 operates in the conventional manner under suitable power to pull the coal in toward the burner assembly 10. The auger tube is connected to a housing 23 that is part of the burner assembly and which forms an elbow so that the horizontal auger opening mates with the elbow opening at 24 and the elbow then curves to form a vertical section 25 that extends upwardly and is formed as an integral part with a burner base plate 26. The burner base plate 26 has a desired thickness, and burner support arms 30 are fixed thereto and are spaced apart. The shaft 21 extends between the support arms 30. The support arms 30 have a cross plate 31 welded thereto for supporting the burner assembly 10 in proper position.

The burner base plate 26 has an irregular cross section, and includes an outer peripheral edge section 33, an intermediate section 34 and a central opening or port 35.

Figure 2:
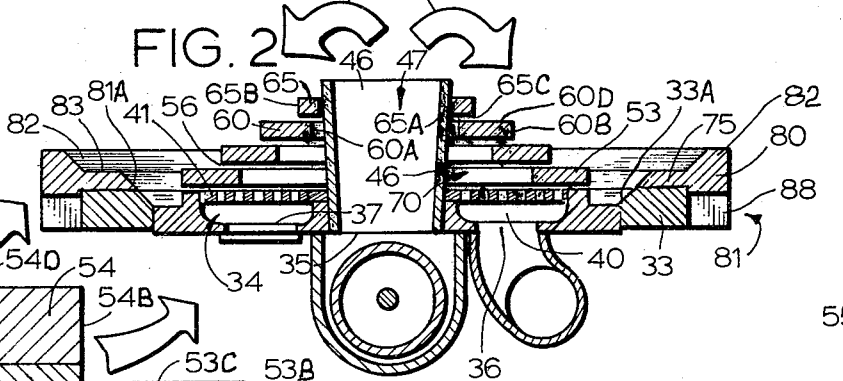
FIG. 2 is a sectional view taken as on line 2—2 in FIG. 1.
Figure 3:
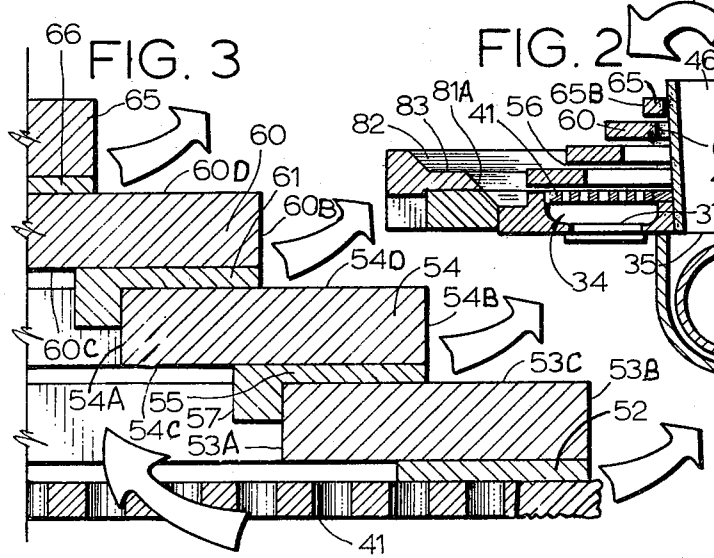
FIG. 3 is an enlarged fragmentary sectional view of a stack of rings forming the burner body.
Figure 5:
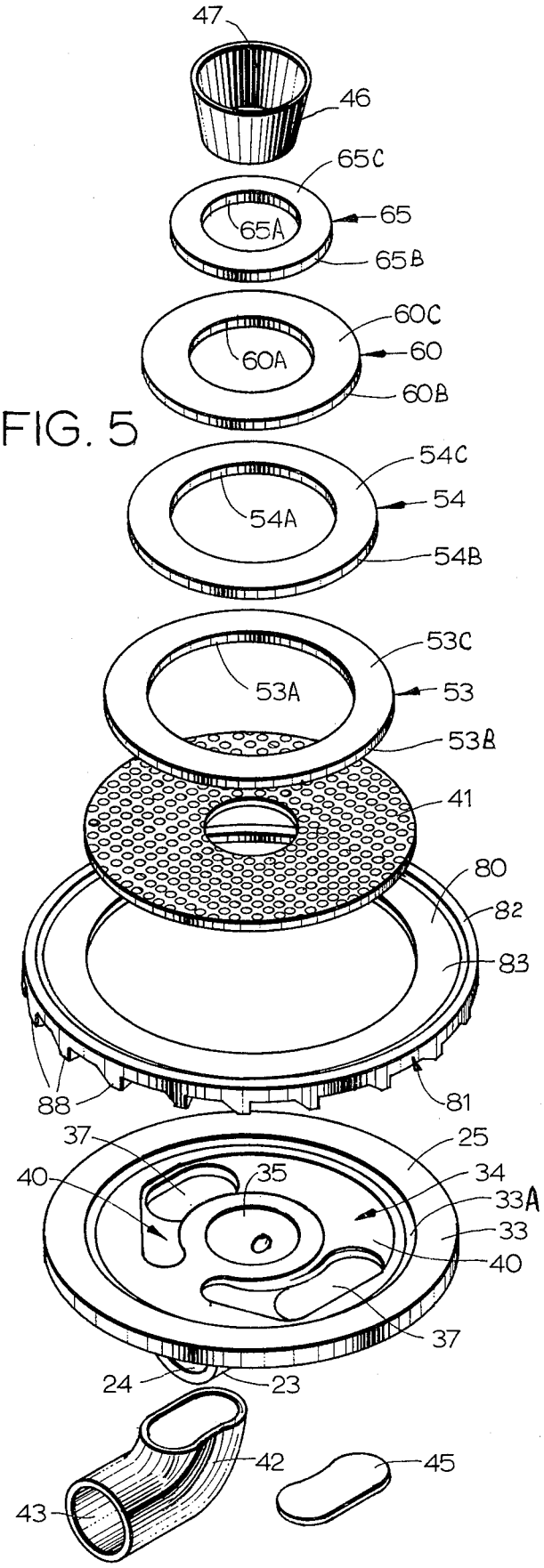
FIG. 5 is an exploded view of a burner assembly made according to the present invention.
Figure 6:
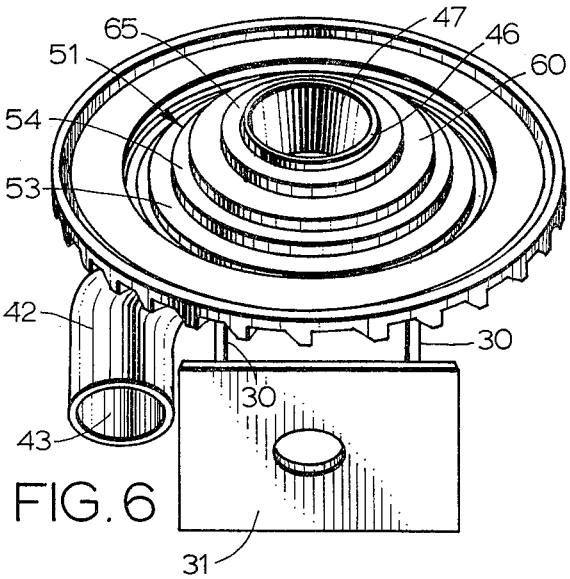
FIG. 6 is a perspective view of the burner assembly of the present invention.
Figure 7:
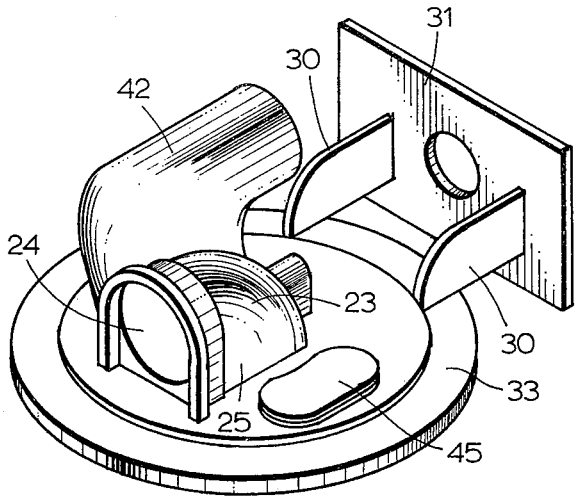
FIGS. 7 and 8 are perspective views of the underside of the burner base of the present invention showing alternative location of the combustion air duct elbow.
Figure 8:
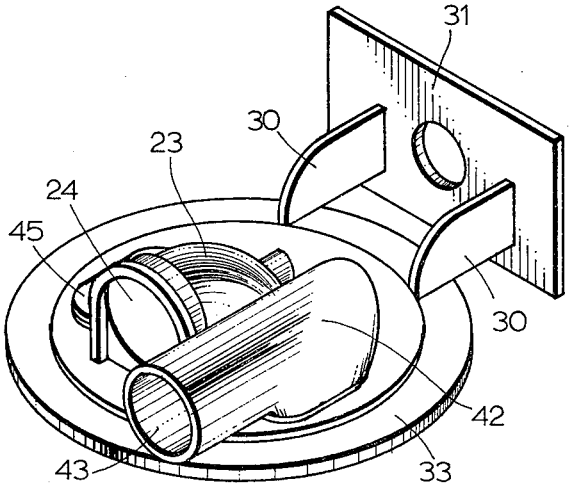

The intermediate section 34 has a pair of air inlet ports 36 and 37, respectively positioned 180° apart, and these two ports open into a recess forming a plenum 40 that is part annular around the intermediate portion 34 of the burner base plate. As shown the plenum is covered with a perforated screen of suitable metal indicated generally at 41. As shown in FIGS. 2, 7 and 8, one of the ports 36 or 37 will be closed when the burner is in use and the other port will be connected to an air duct elbow 42 which as shown is offset between its inlet and its outlet so that the inlet or horizontal port 43 of the elbow 42 is not directly in line with the vertically directed output port of the elbow. The port 43 is offset sufficiently to permit the elbow 42 to be used either as shown in FIG. 8 where the duct for the combustion air will extend parallel to and in the same direction as the tube 22 for the auger 20, or as shown in FIG. 7, the horizontal port 43 can face in the opposite direction along side one of the support arms 30 so that the combustion air duct will extend in an opposite direction and out through an opposite wall of the boiler base or furnace housing.

The port 36 or 37 which is not used is covered with a plate 45, to seal it (the plate 45 may be welded in place), and thus air being supplied to the burner will come into the plenum chamber 40 and be distributed under pressure up through the screen 41, or other distribution baffles if desired. It is desired to provide even air distribution from the plenum which surrounds the coal inlet port 35 of the coal infeed elbow.

In the burner construction, the center port 35 communicates with an upright tubular throat 46. The throat forms a vertical extension of the elbow 25 for discharge of coal from the auger 20 upwardly. The throat 46 has an upper open end port 47 through which coal will discharge generally as shown by the arrows 48 (FIGS. 1 and 2) outwardly over the side of the throat and down onto a tuyère indicated at 51.

The tuyère 51 made according to the present invention comprises a plurality of vertically stacked annular rings having outer peripheral surfaces as well as inner peripheral surfaces that are of decreasing diameter in vertical direction away from the burner body plate 26. The open centers of the stacked rings form a central cavity or chamber through which throat 46 extends.

The burner base plate 26, or the screen 41 as desired, provides a support surface adjacent to the outer edge section 33 for a first burner ring indicated at 53. The ring 53 is supported above plenum chamber 40. The ring 53 has radial rib spacers 52 that create an air gap under the ring 53. The inner edge surface 53A of ring 53 is spaced outwardly from the throat member 46 a substantial amount. The outer edge 53B of ring 53 is spaced inwardly from inner sloping edge 33A of the outer base plate section 33. A recess or receptacle is formed in this area and is part of the combustion chamber 19 as shown in the drawings.

A second tuyère ring 54 is placed in position on top of the ring 53, and as can be seen the ring 54 has an inner annular edge surface 54A which is of smaller diameter than the inner surface 53A, and an outer annular edge surface 54B which is of smaller diameter than the outer surface 53B of the ring 53. Additionally, the ring 54 has a plurality of radial bosses or spacers indicated at 55 on the undersurface thereof. These bosses 55 are selected in thickness so that the undersurface 54C of the ring 54 will be spaced as shown at 56 a distance from the upper surface 53C of the ring 53. Additionally, the bosses 55 each have a small lug 57 at their inner end, which forms a shoulder that fits inside the surface 53A, and serves to center the ring 54 relative to the ring 53 and also to keep the rings vertically spaced to form an annular air discharge space 56 (FIG. 2).

In the form shown, a third ring 60 forming a portion of the tuyère 51 has an inner annular edge surface 60A that is of smaller diameter than the surface 54A, and an outer surface 60B which is of smaller diameter than the outer edge surface 54B. The ring 60 also surrounds the throat 46. A boss or rib 61 spaces the under surface 60C of the ring 60 from the upper surface 54D of the ring 54. This forms an annular air passageway that is of relatively small vertical height and is formed between two horizontal surfaces so that air passing therethrough tends to go horizontally outwardly between the rings 54 and 60.

In the form shown, a third ring 65 has an inner surface 65A that fits closely around the outer surface of the throat 46, and the ring 65 has an outer edge surface 65B that is of smaller diameter than the edge surface 60B of the next lower ring 60. The ring 65 has bosses or ribs 66 that support the ring 65 so that the under surface 65C of the ring 65 is above the upper surface 60D of the ring 60 to form an air passage space 67.

The bosses or ribs 61 and 66 also have end lugs such as lugs 57 that keep the rings concentric and properly positioned as far as radial position is concerned. The lugs do not restrain the rings from rotating relative to each other.

Thus, the tuyère 51 is formed with a plurality of generally parallel rings of decreasing diameter in vertical direction and forming generally horizontal air spaces between the adjacent rings. The rings are formed in a type of a pyramid shape from the upper port 47 of the coal delivery throat down to the outer edge 53A of the lowermost ring. The inner openings of the rings together form a chamber in the center of the burner body between the throat 46 and the inner edge surfaces of the rings. The air from the plenum chamber enters the center cavity 70 and blows outwardly through the spaces between the rings.

It can thus be seen that coal being discharged through the throat 46 out through the port 47 will tend to tumble down over the upper surfaces of the rings 53, 54, 60 and 65 and generally flow outwardly from the coal delivery throat 46.

The combustion air is thus provided through the duct elbow 42 through the respective port 36 or 37 of the burner and will blow out horizontally through the openings between the rings such as those shown at 58, 61 and 67 and into coal which piles along the upper surfaces of the plates and in the burning chamber area 19.

The outer section 33 of the burner base plate has a generally horizontal upper surface 75, and supported on this upper surface is an ash ring 80 that is just rotatably, slidably mounted on the upper surface 75 and is held in place around the outer edge of the outer section 33 of burner base plate 26 through the use of a rim 81 which as will be explained also forms teeth for driving the ash ring 80 rotationally around the central axis of the burner body.

The outer section 33 of the burner base plate as shown has an outwardly and upwardly tapered surface 33A leading from the central surface 52 of the burner base plate 23. Surface 33A forms a slope with respect to a horizontal plane. This forms a type of recessed trough for ashes around the lower end of the burner body. Most of the ashes and coal residue will be deposited between surface 33A and the edge of ring 53. Burning will take place as the coal moves downwardly along the rings forming the tuyère from port 47, and as the coal burns the ashes will tend to settle into this area. In order to prevent clinkers from forming, the ring 80 as shown is rotatably driven on the outer section 33. The ring 80 has an inner tapered edge surface 80A that forms a continuation of the surface 33A. The ash ring has a raised rib indicated at 82 around its outer periphery, and an upper surface 83 that is generally parallel to the upper surfaces of the rings of the burner body, such as ring 53 and extends generally horizontally outward from the burner base plate 26.

The ash ring 80 is rotated through the use of a suitable drive such as a two member paddle 86 that is drivably mounted onto the shaft 21. The paddle also rotates between the support plates 30, as shown. The paddle 86 has two active lugs only, similar to the paddle shown in U.S. Pat. No. 4,007,697.

The lugs of the paddle 86 engage the teeth 88 on the bottom surface of the rotating ring 80 as the paddle rotates. The inner surfaces of the teeth 88 provide a guide surface around the outer edge of the outer section 33 to keep the rotating ash ring 80 in proper position.

When the shaft 21 is driven to drive the auger 20 through the stoker transmission 15, the paddle 86 will rotate, and for each one-half revolution of the auger 20 the paddle will actuate the ash ring rotationally the spacing of one tooth 88. This movement of the ash ring 80 will cause clinkers and chunks of ash to tend to rotate and to be moved and discharged out over the edge of the ash ring 80 to fall down into a provided ash box in conventional manner.

In this manner even burning of coal is provided in a simple manner by having the generally horizontal rings that are spaced apart in vertical direction to form a tuyère and are of decreasing diameter in vertical direction from the burner base plate 26 so that the outer surfaces are somewhat pyramidal or stepped. As the coal moves down over these areas air is discharged in horizontal sheets or jets that are annular around the burner body because of the provision of air through the provided elbow, and as the burning takes place the residues of combustion will be deposited in the lower end of the combustion area, and any clinkers and ash chunks will be broken up by the rotating ash ring and the ashes will be discharged out over the edge of the ring.

Because the drive of this device can be from the opposite end of the auger from the coal bin, it is easier to drive, and the blower for providing air for the burner through the duct elbow 42 can be positioned at either end of the boiler base or furnace housing.

The unit is easily made and when it is cast, the upper surface 75 of the edge section can be "chilled" to make it hard so that the ash ring 80 will not cause excessive wear, and of course any desired type of feeder controls of conventional design can be used.

It should also be noted that the design permits adding rings for forming the tuyère 51 if desired. The burner base plate can be made to have a larger diameter, so that additional rings can be placed under the ring 53, and the throat 46 is left longer so that the port 47 is raised. One throat 46 can be used for several size burners merely by cutting the vertical height of the throat 46 to the desired height to accommodate the number of rings forming the tuyère when fewer rings are used.

The same construction features will be present in any size burner made according to the present invention. The four burner rings form a burner body having generally about 150 lbs of coal per hour capacity, as shown. With seven total rings forming the tuyère about 250 lbs per hour is the burner capacity and a 500 lbs per hour burner has approximately ten of the rings forming a tuyère 51. The speed of the auger determines the rate of feed and burner, and the throat 46 can be cut to the desired height to accommodate the number of rings needed.

What is claimed is:

1. A coal burning apparatus actuated by a stoker comprising a burner base, said burner base including a throat member for connection to a fuel feeding stoker mechanism, and having a generally vertically facing discharge port for transmission of coal at a location above the base;

said base comprising a plate member having said vertically facing discharge port generally centrally located therein, the plate having central portions adjacent said discharge port;

a burner body positioned on said burner plate and extending upwardly and surrounding the throat member, coal delivered through said throat member moving outwardly over the outside of the burner body, said burner body having a central cavity and including air passage means for providing airflow openings generally from the central cavity outwardly through coal that is delivered to the outside of said burner body;

said center portions having a pair of ports positioned on opposite sides of said throat member and within the perimeter of the central cavity, said ports being substantially identical and substantially diametrically opposed;

means to cover a first of said ports to prevent air passage therethrough;

perforated diffuser plate means overlying both ports to diffuse and distribute airflow from the second port to the central cavity of the burner body; and an air flow duct elbow connected to a second of said ports and having a first portion forming an upwardly opening air outlet port and a generally horizontal portion extending in a first horizontal direction, and having its center laterally offset from the center of the air outlet port in a direction extending away from the centrally located, vertically facing discharge port of the base, said duct elbow being formed to be alternatively connectable to said first port with the horizontal portion of the duct extending in the opposite horizonal direction from the first direction of extension when connected to the second port, to selectively permit the air duct to extend from opposite horizontal directions from said burner base.

2. The apparatus of claim 1 wherein said burner base includes a peripheral support spaced outwardly from the burner body, and an ash ring rotatably mounted on said peripheral support and in surrounding spaced relationship to the burner body.

3. The apparatus of claim 1 wherein said burner body comprises a plurality of vertically stacked ring members having open central areas surrounding the throat and forming the central cavity, and means to space said rings apart in vertical direction to form the air passage means.

4. The apparatus specified in claim 1 wherein the upper surface of said burner plate has a part annular recess opening to each of the air ducts, and a perforated plate overlying said recess to cause air flowing through said ducts to be distributed part annularly around the burner body before entering the central cavity.

5. The apparatus of claim 3 wherein said burner body includes a plurality of at least four ring members stacked vertically, and of decreasing outside diameter in vertical direction.

6. The apparatus of claim 2 and means for drivably rotating the ash ring.

7. The apparatus of claim 2 wherein the peripheral support comprises a ring having a conical inner edge surface spaced from the burner body to form an annular trough surrounding the burner body.

8. The apparatus of claim 7 wherein a portion of the ash ring rests on and overlies the peripheral support and has a conical inner edge surface that forms an extension of the conical inner edge surface of the peripheral support and a generally horizontal upper surface which is rotated around the burner body.

9. A coal burning apparatus actuated by an auger-type stoker including a burner base plate, a coal inlet tube extending generally horizontally below the base plate, said inlet tube forming an elbow and extending upwardly through the center portions of said base plate to define a coal discharge port a distance above the upper surface of said base plate;

a first ring portion at the periphery of said base plate forming a generally upwardly facing planar annular surface and defining an annular recessed trough adjacent the outer edge of the base plate;

a plurality of burner rings supported on said base plate and stacked in vertical direction, said burner rings having open central portions surrounding the inlet tube and having outer peripheral surfaces of decreasing size in vertical upward direction, said burner rings being spaced apart in vertical direction to form generally horizontal air discharge passageways between adjacent burner rings that provide airflow paths extending generally parallel to the adjacent burner rings beyond the outer edges of the lower of the adjacent burner rings for each such airflow path, the upper one of the burner rings surrounding the coal discharge port and receiving coal discharged therefrom, the lowermost burner ring having an outer peripheral edge spaced inwardly from the first ring portion, each burner ring having an upwardly facing annular surface exposed to support coal supplied from the coal discharge port and moving downwardly toward the trough under gravity;

means comprising large port means to provide a supply of combustion air under pressure to the open central portions of the burner rings, air diffuser means between the port means and the open central portions to distribute air to the open central portions prior to being directed substantially horizontally outwardly through the air discharge passageways;

a rotating ash ring rotatably mounted for rotational movement on the upwardly facing planar surface of said first ring portion and being spaced outwardly from the burner rings and supported only on the first ring portion, said rotating ash ring having an inner edge surface that is beveled outwardly in upward direction and terminating at a level above the lowermost burner plate; and means actuated by said stoker drive to rotate said rotating ash ring to cause ashes forming between the burner rings and said rotating ash ring to be engaged by the ash ring and discharged outwardly as the ashes build up.

10. The apparatus of claim 9 wherein each of said burner rings include a plurality of ribs on the lower surfaces thereof to space the rings in vertical direction.

11. The apparatus of claim 9 wherein the means to provide a supply of combustion air includes a plenum chamber formed in said base plate and open to the open centers of the burner rings through said diffuser means, said base plate having a pair of ports defined therethrough opening to the plenum chamber, an air supply duct elbow, one of said ports being connected to the air supply duct elbow and the other port being closed, but being adapted to be coupled to the air supply duct elbow with an inlet portion of the elbow facing in opposite direction from the direction it faces when the elbow is connected to the one port.

* * * * *

UNITED STATES PATENT AND TRADEMARK OFFICE

CERTIFICATE OF CORRECTION

PATENT NO. : 4,449,462

DATED : May 22, 1984

INVENTOR(S) : Michael F. Robb

It is certified that error appears in the above-identified patent and that said Letters Patent is hereby corrected as shown below:

Column 6, line 36, (Claim 1, line 7) before "plate" insert --burner--.

Signed and Sealed this

*Thirteenth* Day of *November 1984*

[SEAL]

*Attest:*

GERALD J. MOSSINGHOFF

*Attesting Officer*

*Commissioner of Patents and Trademarks*